US006158871A

United States Patent [19]

Geddes et al.

[11] Patent Number: 6,158,871

[45] **Date of Patent: *Dec. 12, 2000**

[54] ILLUMINATING BALL-POINT PEN

[75] Inventors: William T. Geddes, Cockeysville, Md.; Craig A. Bunker, Glen Rock, Pa.

[73] Assignee: Raymond Geddes Company, Inc, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 09/172,627

[22] Filed: Oct. 14, 1998

[51] Int. Cl.[7] ..... B43K 29/10

[52] U.S. Cl. ..... 362/118; 362/186; 362/205

[58] Field of Search ..... 362/118, 109, 362/120, 186, 205

[56] References Cited

U.S. PATENT DOCUMENTS

| | | | |
|---|---|---|---|
| 5,275,497 | 1/1994 | Shiau | 401/195 |
| 5,413,429 | 5/1995 | Shiau | 401/195 |
| 5,673,996 | 10/1997 | Ducker | 362/118 |
| 5,735,592 | 4/1998 | Shu | 362/118 |
| 5,803,583 | 9/1998 | Hsieh | 362/118 |

*Primary Examiner*—Stephen Husar
*Attorney, Agent, or Firm*—H. Jay Spiegel

[57] ABSTRACT

An illuminating ball-point pen includes an elongated tubular holder, a hollow protective member fitted on an upper end of the elongated tubular holder, a battery mounting arranged inside the protective seat, batteries fitted inside the battery mounting and electrically connected in series, a seat mounted in a top of the battery mounting, a metal stopper mounted under the battery mounting and having a bottom provided with a flange, a spring enclosing the battery mounting and the metal stopper and having an upper end bearing against the battery mounting and a lower end bearing against the flange of the metal stopper, a light bulb disposed on the seat and having a leg extending downwardly through the seat to contact an electrode of the batteries and another leg extending downwardly between the battery mounting and the spring, a transparent hood engageable with an upper end of the hollow protective member, and a reservoir tube fitted inside the elongated tubular holder and having an upper end bearing against a bottom of the metal stopper, whereby the illuminating ball-point pen will automatically give light in use.

15 Claims, 4 Drawing Sheets

(40 ~ 40)

(30 ~ 30)

ILLUMINATING BALL-POINT PEN

BACKGROUND OF THE INVENTION

1. Field of the Invention

This invention is related to an illuminating ball-point pen and in particular to one which will automatically give light in use.

2. Description of the Prior Art

It has been found that the operation of the conventional illuminating ball-point pens falls into the following categories:

1. Rotating the upper pen holder with respect to the lower pen holder to turn on the light inside the pen;
2. Depressing the button on the pen holder to turn on the light inside the pen; and
3. Turning a switch on the pen holder to power on the light inside the pen.

However, such illuminating ball-point pens cannot automatically give light thereby causing much inconvenience in use.

Furthermore, the conventional ball-point pen utilize commonly used alkali batteries which are large in size and heavy in weight. In addition, the reservoir tube of the conventional ball-point pen must be shortened in order to fit inside hence reducing its service life. Moreover, the light of the conventional illuminating pen is designed for use as a flashlight, but not for fun.

Therefore, it is an object of the present invention to provide an illuminating ball-point pen which can obviate and mitigate the above-mentioned drawbacks.

SUMMARY OF THE INVENTION

This invention is related to an illuminating ball-point pen.

It is the primary object of the present invention to provide an illuminating ball-point pen which will automatically give light in use.

It is another object of the present invention to provide an illuminating ball-point pen which does not need a button for operation.

It is still another object of the present invention to provide an illuminating ball-point pen which is attractive and interesting in use.

It is still another object of the present invention to provide an illuminating ball-point pen which is simple in construction.

It is a further object of the present invention to provide an illuminating ball-point pen which is low in cost and easy to manufacture.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
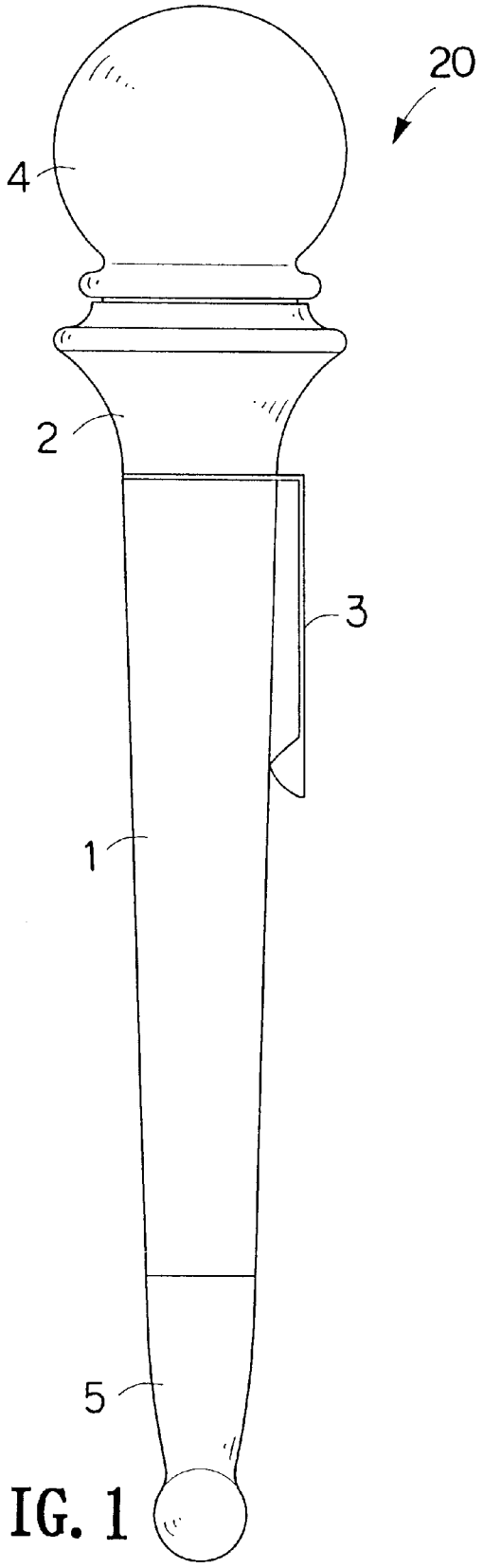
FIG. 1 is a front view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
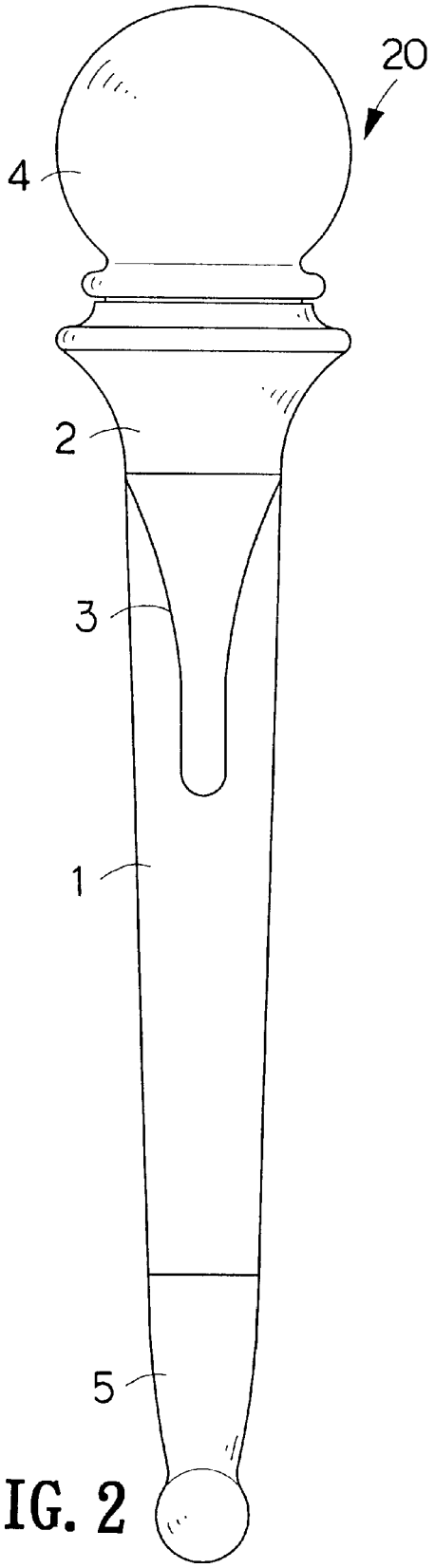
FIG. 2 is a side view of the present invention.

With reference to the drawings and in particular to FIGS. 1 and 2 thereof, the illuminating ball-point pen 20 according to the present invention generally comprises a holder 1, a hollow protecting member 2 mounted on the upper end of the holder 1, a clip 3 fitted between the holder 1 and the hollow protective member 2, a transparent (or translucent) spherical hood 4 arranged on the protecting seat 2, and a cap 5 engageable with the lower end of the holder 1.

Figure 3:
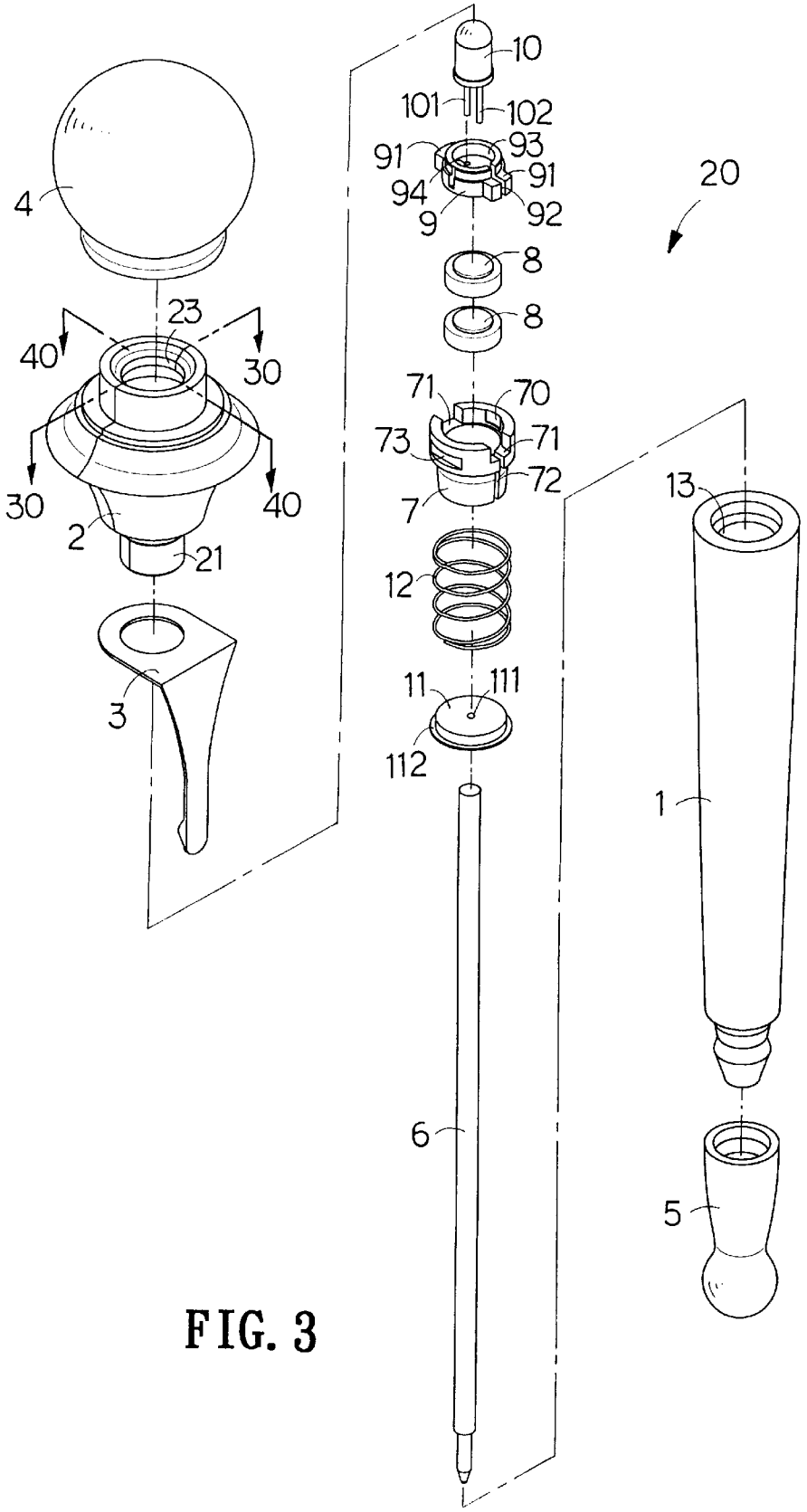
FIG. 3 is an exploded view of the present invention.
Figure 6:
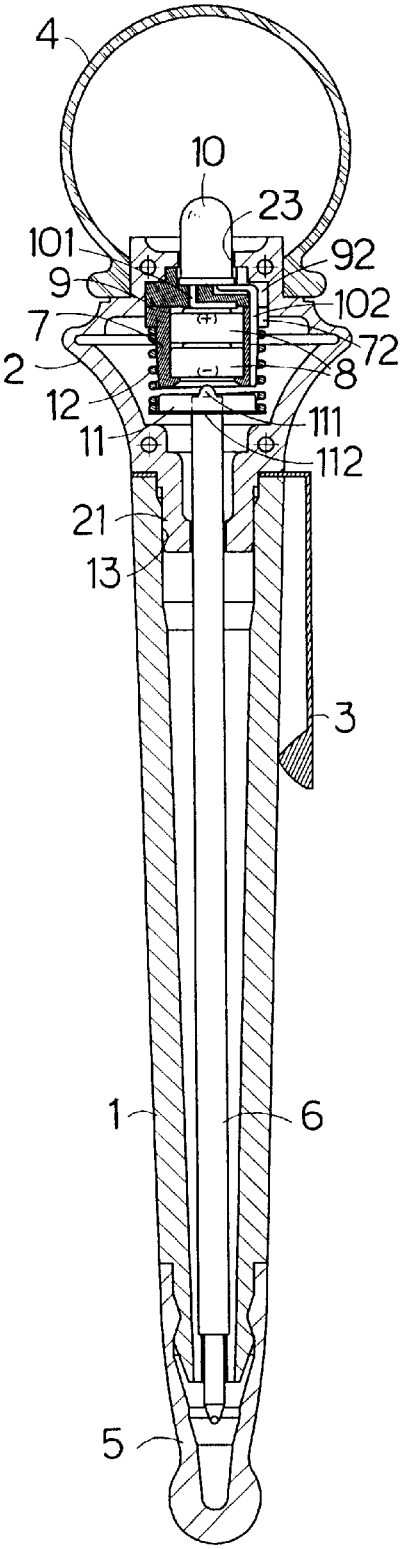
FIG. 6 is a sectional view of the present invention when not in use.

Referring to FIGS. 3 and 6, the holder 1 is an elongated tubular member in which is fitted a reservoir tube 6. The upper end of the holder 1 has an opening 13 for receiving the lower end 21 of the hollow protective member 2. The hollow protective member 2 is composed of two symmetric halves fixedly joined together. The hollow protective member is a hollow member in which are disposed a battery mounting 7 for receiving two batteries 8 electrically connected in series, a seat 9 mounted on the battery mounting 7, a light-emitting means 10 such as a light bulb fitted in the seat 9, a metal stopper 11 arranged under the battery mounting 7, a metal spring 11 fitted over the battery mounting 7 and the metal stopper 11.

The battery mounting 7 has an upper end 70 having two recesses 73 at two opposite positions of its outer side and two aligned notches 71 one of which is formed with a vertical slit 72. The seat 9 has two protuberances 91 at two opposite sides configured to be fitted in the two notches 71 of the battery mounting 7. One of the protuberances 91 is formed with a vertical slit 92 aligned with the slit 72 of the battery mounting 7. The upper end of the seat 9 has a cavity 93 formed with a hole 94. The metal stopper 11 is provided with a projection 111 at the center of the top and a flange 112 at the bottom.

Figure 5:
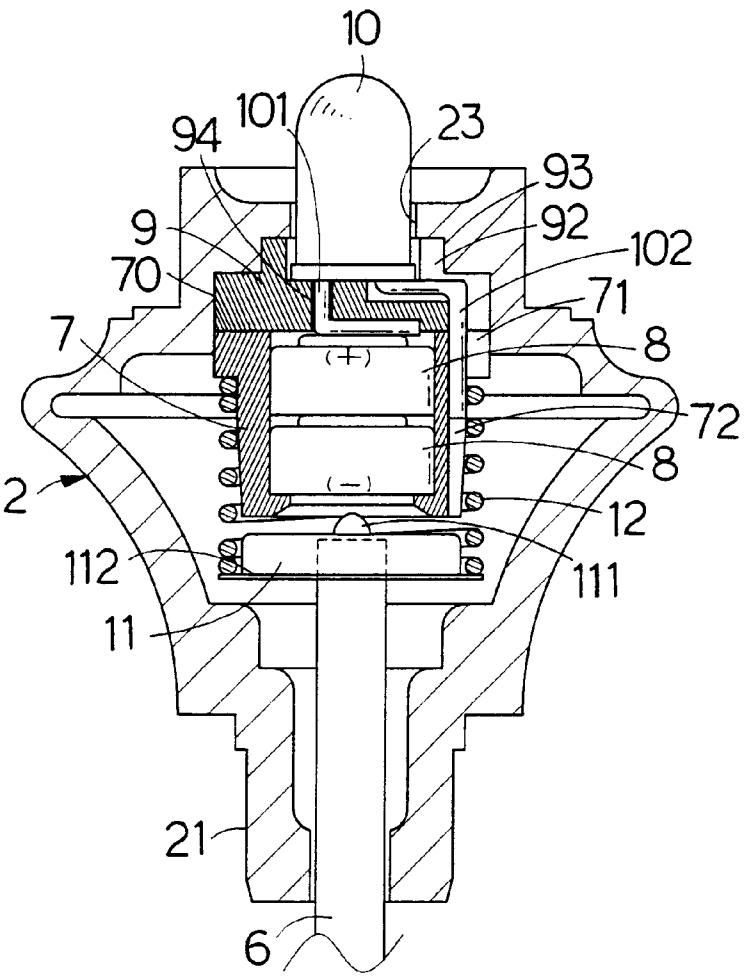
FIG. 5 is a sectional view taken along line 40—40 of FIG. 3.
Figure 4:
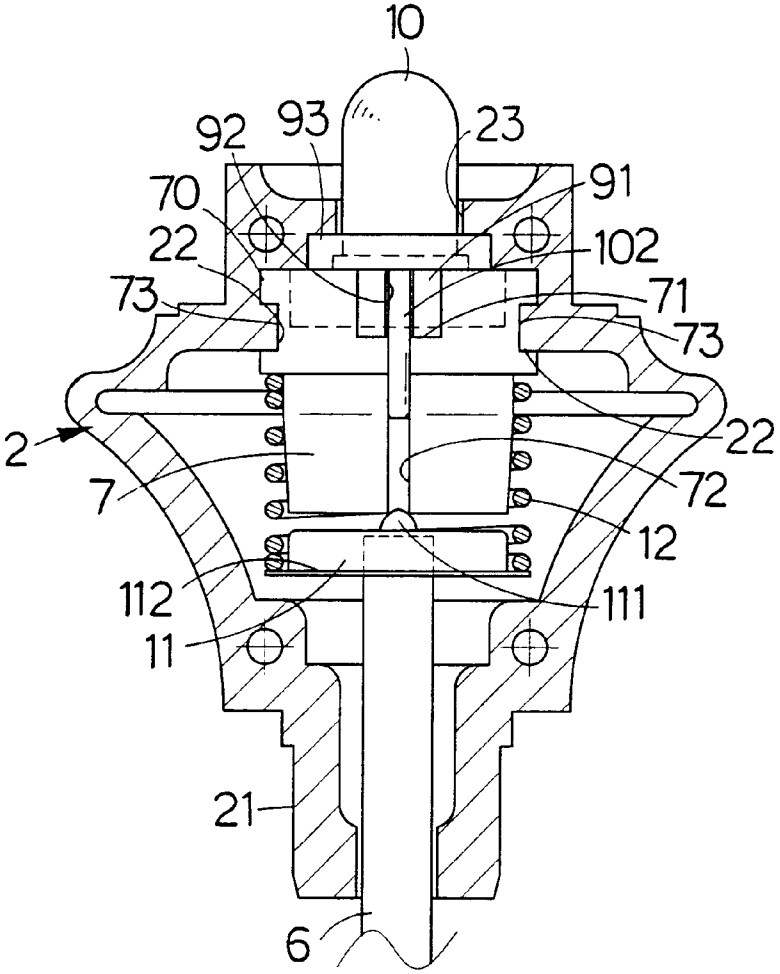
FIG. 4 is a sectional view taken along line 30—30 of FIG. 3.

Referring to FIGS. 4 and 5, the light-emitting means 10 has a leg 101 extending through the hole 94 of the seat 9 to contact the positive electrode of the battery 8 (see FIG. 5). Another leg 102 of the light-emitting means 10 extends through the slit 92 of the seat 9 and the slit 72 of the battery mounting 7 to fit between the spring 12 and the battery mounting 7. The lower portion of the spring 12 is fitted over the metal stopper 11, with its lower end bearing against the flange 112 of the metal stopper 11 thereby pushing the projection 111 of the metal stopper 11 downwardly away from the negative electrode of the battery 8. The recesses 73 of the battery mounting 7 are engaged with the inner neck portion 22 of the protective seat 2 thereby preventing the battery mounting 7 from disengaging from the protective seat 2 (see FIG. 4). The light-emitting means 10 extends upwardly through an opening 23 of the protective seat 2.

In assembly, the two batteries 8 are first fitted inside the battery mounting 7 and the seat 9 is arranged in the upper end 70 of the battery mounting 7. Then, the light-emitting means 10 is inserted in the seat 9 and the spring 12 is fitted over the battery mounting 7 and the metal stopper 8. Thereafter, the combination of the above-mentioned componenent parts is fitted inside the protective seat 2 and the clip 3 is mounted on the upper end of the holder 1. Then, the lower end of the protective seat 2 is engaged with the upper end of the holder 1, with the upper end of the reservoir tube 6 extending into the protective seat 2 to bear against the metal stopper 11. Finally, the transparent spherical cover 4 is engaged with the upper end of the protective seat 2 and the cap 5 is fitted over the lower end of the holder 1.

Figure 7:
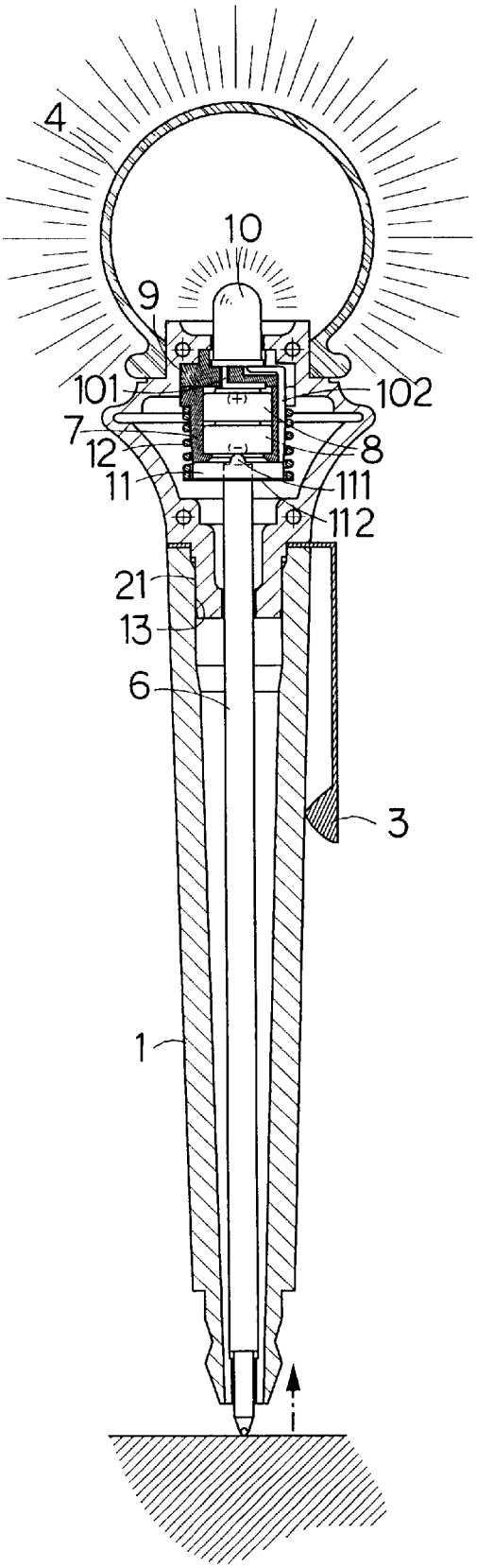
FIG. 7 is a sectional view of the present invention when in use.

Referring to FIG. 7, when in use, the user will apply a pressure on the reservoir tube 6 which will then be forced to go upwardly to urge the metal stopper 11 to contact the negative electrode of the battery 8 thereby turning on the light-emitting means 10. In the meantime, the spherical hood 4 is made of transparent or translucent material so that the light from the light-emitting means 10 will go therethrough make the pen give light.

As the user moves the pen away from the desk, the spring 12 will force the metal stopper 11 to go downwardly away from the negative electrode of the battery 8 thus turning off the light-emitting means 10.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An illuminating ball-point pen comprising:

an elongated tubular holder;

a hollow protective member fitted on an upper end of said elongated tubular holder;

a battery mounting arranged inside said protective seat;

batteries fitted inside said battery mounting and electrically connected in series;

a seat mounted in a top of said battery mounting;

a metal stopper mounted under said battery mounting and having a bottom provided with a flange;

a spring enclosing said battery mounting and said metal stopper and having an upper end bearing against said battery mounting and a lower end bearing against said flange of said metal stopper;

a light-emitting means disposed on said seat and having a leg extending downwardly through said seat to contact an electrode of said batteries and another leg extending downwardly between said battery mounting and said spring;

a transparent hood engageable with an upper end of said hollow protective member; and a reservoir tube fitted inside said elongated tubular holder and having an upper end bearing against a bottom of said metal stopper.

2. The illuminating ball-point pen as claimed in claim 1, wherein said battery mounting has an upper end configured to receive said seat and formed with two aligned notches, said seat being formed with two aligned protuberances configured to be fitted in said two aligned notches, said battery mounting having an outer side formed with two opposite recesses, said protective seat having an inner neck portion configured to engage with said recesses.

3. The illuminating ball-point pen as claimed in claim 1, wherein said seat has a cavity formed with a hole for receiving a leg of said light-emitting means, said battery mounting being formed with a vertical slit, said seat having a vertical slit aligned with said vertical slit of said battery mounting.

4. The illuminating ball-point pen as claimed in claim 1, further comprising a transparent or translucent hood engageable with said protective seat.

5. The illuminating ball-point pen as claimed in claim 1, wherein said metal stopper has a top provided with a projection arranged against an electrode of said battery.

6. An illuminating ball-point pen comprising:

an elongated holder having an upper protection portion within an inner cavity;

a battery mounting arranged inside said cavity;

at least one battery fitted inside said battery mounting;

a metal stopper mounted under said battery mounting and having a bottom;

a spring having an upper end bearing against said battery mounting and a lower end bearing against said metal stopper;

a light-emitting means disposed on said battery mounting and having a first conductive leg contacting a first electrode of said at least one battery and a second leg electrically connected to said stopper; and a reservoir tube fitted inside said elongated holder and having an upper end bearing against a bottom of said metal stopper;

upward reciprocation of said reservoir tube against spring bias of said spring engaging said stopper with a second electrode of said at least one battery thereby causing illumination of said light emitting means.

7. The illuminating ball-point pen as claimed in claim 6, wherein said battery mounting has an upper end configured to receive a seat adapted to receive said light emitting means, said battery mounting being formed with two aligned notches, said seat being formed with two aligned protuberances configured to be fitted in said two aligned notches, said battery mounting having an outer side formed with two opposite recesses, said protective member having an inner neck portion configured to engaged with said recesses.

8. The illuminating ball-point pen as claimed in claim 7, wherein said seat has a cavity formed with a hole for receiving said first conductive leg of said light-emitting means, said battery mounting being formed with a vertical slit, said seat having a vertical slit aligned with said vertical slit of said battery mounting.

9. The illuminating ball-point pen as claimed in claim 6, further comprising a transparent or translucent hood engageable with said protective seat.

10. The illuminating ball-point pen as claimed in claim 6, wherein said metal stopper has a top provided with a projection engageable against an electrode of said battery.

11. The illuminating ball-point pen as claimed in claim 6, wherein said holder is tubular.

12. The illuminating ball-point pen as claimed in claim 6, wherein said upper protective portion comprises a hollow protective member fitted on an upper end of said elongated holder.

13. The illuminating ball-point pen as claimed in claim 12, wherein said holder is tubular.

14. The illuminating ball-point pen as claimed in claim 6, wherein said at least one battery comprises a plurality of batteries connected together in series.

15. The illuminating ball-point pen as claimed in claim 6, wherein said spring surrounds said battery mounting and includes a lower end bearing against a flange of said metal stopper.

* * * * *